US012259174B2

(12) United States Patent
Yonezu

(10) Patent No.: US 12,259,174 B2
(45) Date of Patent: Mar. 25, 2025

(54) DEFROSTING CONTROL SYSTEM, DEFROSTING CONTROL METHOD, AND RECORDING MEDIUM

(71) Applicant: Panasonic Intellectual Property Management Co., Ltd., Osaka (JP)

(72) Inventor: Tomohiro Yonezu, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 169 days.

(21) Appl. No.: 18/020,383

(22) PCT Filed: Nov. 30, 2021

(86) PCT No.: PCT/JP2021/043938
§ 371 (c)(1),
(2) Date: Feb. 8, 2023

(87) PCT Pub. No.: WO2022/118856
PCT Pub. Date: Jun. 9, 2022

(65) Prior Publication Data

US 2023/0304724 A1 Sep. 28, 2023

(30) Foreign Application Priority Data

Dec. 4, 2020 (JP) ..... 2020-202259

(51) Int. Cl.
*F25D 21/00* (2006.01)

(52) U.S. Cl.
CPC ..... *F25D 21/006* (2013.01)

(58) Field of Classification Search
CPC ..... F25D 23/00; F25D 21/08; F25D 21/04; F25D 21/006; F25D 2700/12; H02J 13/00004
See application file for complete search history.

(56) References Cited

U.S. PATENT DOCUMENTS 8,983,672 B2 * 3/2015 Kim ..... G05B 15/02 700/297
9,534,821 B2 * 1/2017 Yoon ..... F25D 29/00
(Continued)

FOREIGN PATENT DOCUMENTS

JP 2007-205611 A 8/2007
JP 2014-128106 A 7/2014
(Continued)

OTHER PUBLICATIONS

International Search Report issued on Jan. 11, 2022 in International Patent Application No. PCT/JP2021/043938, with English translation.

*Primary Examiner* — Nelson J Nieves
*Assistant Examiner* — Meraj A Shaikh
(74) *Attorney, Agent, or Firm* — Rimon P.C.

(57) ABSTRACT

A defrosting control system includes an obtainer, a setting unit, and an outputter. The obtainer obtains schedule information indicating whether power saving is scheduled for a temporary power saving request. The setting unit sets a defrosting schedule including an execution time period and an execution interval of defrosting control for refrigeration equipment, based on the schedule information obtained by the obtainer. The outputter outputs an instruction to execute the defrosting control for the refrigeration equipment according to the defrosting schedule set by the setting unit.

6 Claims, 5 Drawing Sheets

(56) References Cited

U.S. PATENT DOCUMENTS

| | | | | |
|---|---|---|---|---|
| 2010/0101254 | A1* | 4/2010 | Besore | H02J 3/14 62/340 |
| 2012/0083927 | A1* | 4/2012 | Nakamura | F24F 11/64 700/278 |
| 2014/0222234 | A1 | 8/2014 | Hirayama | |
| 2015/0308703 | A1 | 10/2015 | Haze | |
| 2017/0302077 | A1 | 10/2017 | Yabe et al. | |

FOREIGN PATENT DOCUMENTS

| | | | | |
|---|---|---|---|---|
| JP | 2015-216833 | A | | 12/2015 |
| JP | 2016208747 | A | * | 12/2016 |
| WO | 2016/071956 | A1 | | 5/2016 |
| WO | 2018/154727 | A1 | | 8/2018 |

* cited by examiner

| DR time | Execution time |
|---|---|
| 0:00 | 0:00, 6:00, ... |
| 0:30 | 0:30, 6:30, ... |
| ... | ... |
| 13:00 | 1:00, 7:00, 13:00, 19:00, ... |
| ... | ... |

DEFROSTING CONTROL SYSTEM, DEFROSTING CONTROL METHOD, AND RECORDING MEDIUM

CROSS-REFERENCE OF RELATED APPLICATIONS

This application is the U.S. National Phase under 35 U.S.C. § 371 of International Patent Application No. PCT/JP2021/043938, filed on Nov. 30, 2021, which in turn claims the benefit of Japanese Patent Application No. 2020-202259, filed on Dec. 4, 2020, the entire disclosures of which Applications are incorporated by reference herein.

TECHNICAL FIELD

The present disclosure relates to a defrosting control system, a defrosting control method, and a recording medium that control defrosting of refrigeration equipment.

BACKGROUND ART

Patent Literature (PTL) 1 discloses a control device that controls a cooling process for cooling a product and a defrosting process for removing frost formed. The control device includes a temperature detector, a calculator, and a cooling device controller. The temperature detector detects the temperature of the product. The calculator calculates the K-value of the product when the expiration date of the product has passed, using the temperature detector. This calculation is performed based on the K-value of the product at the time when the display of the product is started, the temperature detected by the temperature detector, and a pre-established relation between the temperature detected by the temperature detector and an amount of change over time of the K-value of the product. The cooling device controller controls the cooling process and the defrosting process so that the K-value calculated by the calculator falls within a predetermined acceptable range.

CITATION LIST

Patent Literature

[PTL 1] Japanese Unexamined Patent Application Publication No. 2007-205611

SUMMARY OF INVENTION

Technical Problem

The present disclosure provides a defrosting control system and so on that can easily meet the need for reducing power consumption in response to a power saving request.

Solution to Problem

A defrosting control system according to an aspect of the present disclosure includes an obtainer, a setting unit, and an outputter. The obtainer obtains schedule information indicating whether power saving is scheduled for a temporary power saving request. The setting unit sets a defrosting schedule including an execution time period of defrosting control for refrigeration equipment and an execution interval of the defrosting control, based on the schedule information obtained by the obtainer. The outputter outputs an instruction to execute the defrosting control for the refrigeration equipment according to the defrosting schedule set by the setting unit.

A defrosting control method according to an aspect of the present disclosure includes obtaining, setting, and outputting. In the obtaining, schedule information indicating whether power saving is scheduled for a temporary power saving request is obtained. In the setting, a defrosting schedule including an execution time period of defrosting control for refrigeration equipment and an execution interval of the defrosting control is scheduled based on the schedule information obtained in the obtaining. In the outputting, an instruction to execute the defrosting control for the refrigeration equipment according to the defrosting schedule set in the setting is outputted.

A recording medium according to an aspect of the present disclosure is a non-transitory computer-readable recording medium that has recorded thereon a program for causing one or more processors to execute the defrosting control method.

Advantageous Effects of Invention

A defrosting control system and so on according to the present disclosure have the advantage of easily meeting the need for reducing power consumption in response to a power saving request.

DESCRIPTION OF EMBODIMENTS (Underlying Knowledge Forming Basis of the Present Disclosure)

First, the viewpoint of the inventor will be described below.

Conventionally, for example, in order to maintain the quality of a product (item) such as a perishable food, a showcase for refrigerating or freezing (refrigeration equipment) in which the product is displayed in a refrigerated or frozen state is provided in a store such as a convenience store. In a process for cooling such a refrigeration equipment by a cooling device, moisture in the air may be solidified to form frost on the cooling device, that is, so-called frost formation may occur. When frost is formed on the cooling device, the cooling performance of the cooling device deteriorates and thus the problem of quality degradation of the product may arise.

Therefore, in the conventional way, defrosting control is periodically executed to remove frost on the cooling device. The defrosting control is executed, for example, by stopping the operation of the cooling device to increase the inside temperature of the refrigeration equipment. Furthermore, the defrosting control is executed, for example, by heating with a heater to increase the inside temperature of the refrigeration equipment.

In recent years, there is a growing need for a system that, in response to a power saving request such as a Demand Response (DR), executes power saving control in a time period that is designated by the power saving request, for example. Since power consumption of a refrigeration equipment as above is relatively high, it is considered that the refrigeration equipment may become a target for the power saving control.

However, when the power saving control is executed on the refrigeration equipment simply in response to a power saving request, there is a risk that the refrigeration equipment cannot achieve the original objective of maintaining the quality of the product. On the other hand, it is considered that the defrosting control can be incorporated in the power saving control for the refrigeration equipment.

In view of the above, the inventor has conceived the present disclosure.

Hereinafter, an embodiment will be described in detail with reference to the Drawings. However, there are instances where excessively detailed description is omitted. For example, detailed description of well known matter or repeated description of essentially similar elements may be omitted. This is to make the following description easier for those skilled in the art to understand and avoid redundancy.

It should be noted that the inventor provides the accompanying drawings and the following description not to limit the scope of the claims, but to aid those skilled in the art to adequately understand the present disclosure.

Embodiment

1-1. Overall Configuration

Figure 1:
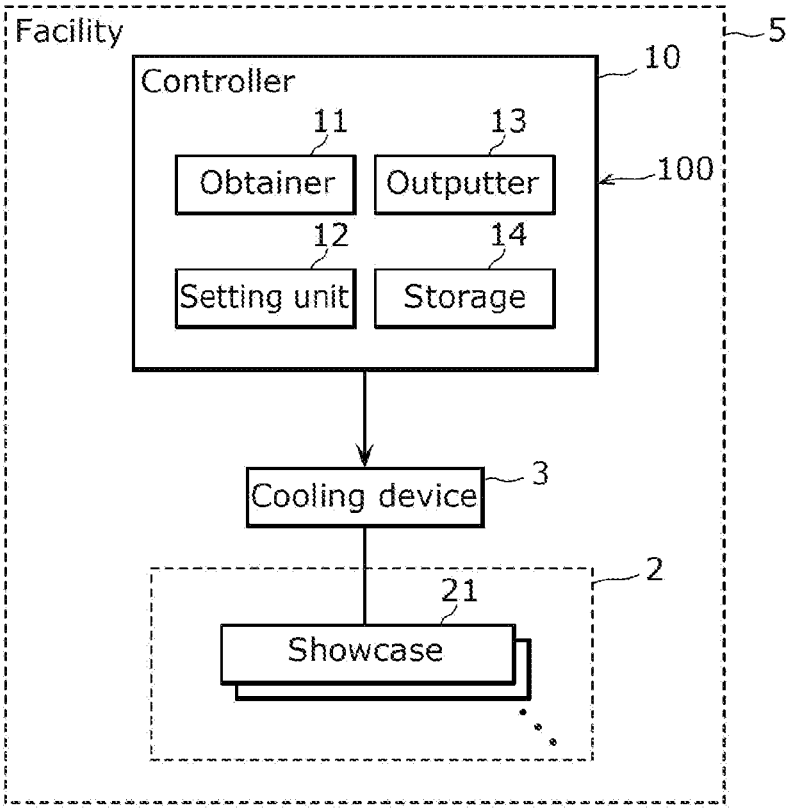
FIG. 1 is a block diagram illustrating an example of the overall configuration including a defrosting control system according to an embodiment.

First, the overall configuration including defrosting control system 100 according to an embodiment will be described with reference to FIG. 1. FIG. 1 is a block diagram illustrating the overall configuration including defrosting control system 100 according to the embodiment. Defrosting control system 100 is a system for executing defrosting control for refrigeration equipment 2 that is provided in facility 5. In particular, defrosting control system 100 according to the embodiment is a system for executing, in a case where a power saving request is issued, defrosting control for refrigeration equipment 2 according to a defrosting schedule taking the power saving request into account.

Here, for example, the power saving request is not a permanent request but a temporary request such as a DR as described above. Furthermore, other than a DR as described above, the power saving request may be a request for peak shaving for suppressing power consumption during a peak time of power demand. Furthermore, the power saving request may be a request for suppressing power consumption during a time when an electricity rate is relatively high based on an electricity rate in the electricity balancing market. For example, the power saving request is transmitted from an external system that is operated by an electric power company or an aggregator or the like in a virtual power plant (VPP).

For example, examples of facility 5 may include a food store, such as a convenience store or a supermarket. Specifically, facility 5 is, for example, a store that is provided with refrigeration equipment 2 for refrigerating or freezing food and so on to maintain the quality of the food and so on. In the embodiment, facility 5 is assumed to be a food store. It should be noted that facility 5 is not limited to a store as long as facility 5 includes refrigeration equipment 2.

Refrigeration equipment 2 is equipment for maintaining the quality of a product (item) such as food by refrigerating or freezing the product, as described above. In the embodiment, refrigeration equipment 2 is one or more (here, a plurality of) showcases 21. One or more products are displayed in each of showcases 21.

Refrigeration equipment 2 is cooled by cooling device 3. Cooling device 3 cools the one or more products displayed in each of showcases 21 by sending cool air to the inside of each of showcases 21. It should be noted that although the plurality of showcases 21 are cooled by a single cooling device 3 in the embodiment, they may be cooled by a plurality of cooling devices 3. In such a case, each of showcases 21 is cooled by corresponding one of the plurality of cooling devices 3.

1-2. Defrosting Control System

Next, defrosting control system 100 will be described in detail. As illustrated in FIG. 1, defrosting control system 100 includes obtainer 11, setting unit 12, outputter 13, and storage 14. It should be noted that, in the embodiment, defrosting control system 100 may include at least obtainer 11, setting unit 12, and outputter 13, and defrosting control system 100 needs not include other constituent elements. For example, storage 14 can be implemented by a storage device that is separate from defrosting control system 100.

In the embodiment, defrosting control system 100 is implemented by controller 10 installed in facility 5. Controller 10 is connected to cooling device 3 by a signal line. Controller 10 communicates with cooling device 3 via the signal line. It should be noted that communication between controller 10 and cooling device 3 may be wireless communication. Furthermore, in a case where heater 4 for heating refrigeration equipment 2 is provided as described later, controller 10 is connected to heater 4 by a signal line and communicates with heater 4 via the signal line. Communication between controller 10 and heater 4 may be wireless communication.

Controller 10 includes a processor and memory and implements various functions by the processor executing a computer program stored in the memory. In the embodiment, the memory is storage 14.

Obtainer 11 obtains schedule information indicating whether power saving is scheduled for a temporary power saving request. For example, obtainer 11 obtains the schedule information of the current day (hereinafter, referred to as "execution day") at a predetermined time (at 0:00, for example). Here, the schedule information may be reliable information indicating that power saving is or is not going to be requested by a power saving request on the execution day, and may also be prediction information indicating that power saving will or will not be requested by a power saving request on the execution day.

Specifically, obtainer 11 obtains the schedule information by, for example, receiving information transmitted from an external system that notifies in advance whether power saving is going to be requested by a power saving request on the execution day or predicts whether power saving will be requested by a power saving request on the execution day.

Furthermore, obtainer 11 may obtain the schedule information by prediction based on the execution history of the past power saving requests. Hereinafter, prediction examples by obtainer 11 will be described. It should be noted that obtainer 11 may predict the schedule information using any of a first prediction example to a third prediction example, which are to be described below, or using other method.

In the first prediction example, obtainer 11 predicts a power saving time period of the execution day scheduled for a power saving request by regarding, as the power saving time period, a typical value of the time periods during each of which power saving was requested by a power saving request within the last few days before the execution day. The typical value is an average value, a median value, a mode value, or the like. Furthermore, in a case where power saving was not requested by a power saving request within the last few days before the execution day, obtainer 11 predicts that power saving will not be requested by a power saving request on the execution day.

In the second prediction example, in a case where power saving was requested by a power saving request on the day of the last year corresponding to the execution day, obtainer 11 predicts a power saving time period of the execution day scheduled for a power saving request by regarding, as the power saving time period, the time period during which power saving was requested by the power saving request on the day of the last year corresponding to the execution day. Furthermore, in a case where power saving was not requested by a power saving request on the day of the last year corresponding to the execution day, obtainer 11 predicts that power saving will not be requested by a power saving request on the execution day.

In the third prediction example, obtainer 11 obtains the schedule information by prediction using a model that is trained to use, as an input, the execution history of the past power saving requests and to output information indicating whether power saving will be requested by a power saving request on the execution day.

Figure 3A:
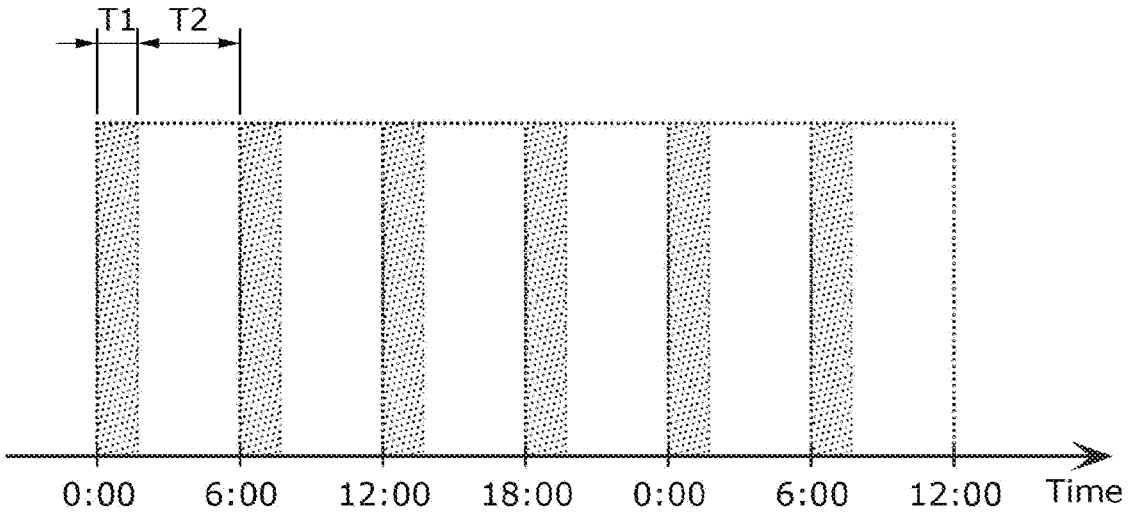
FIG. 3A is a time chart illustrating an example of a normal defrosting schedule.
Figure 3B:
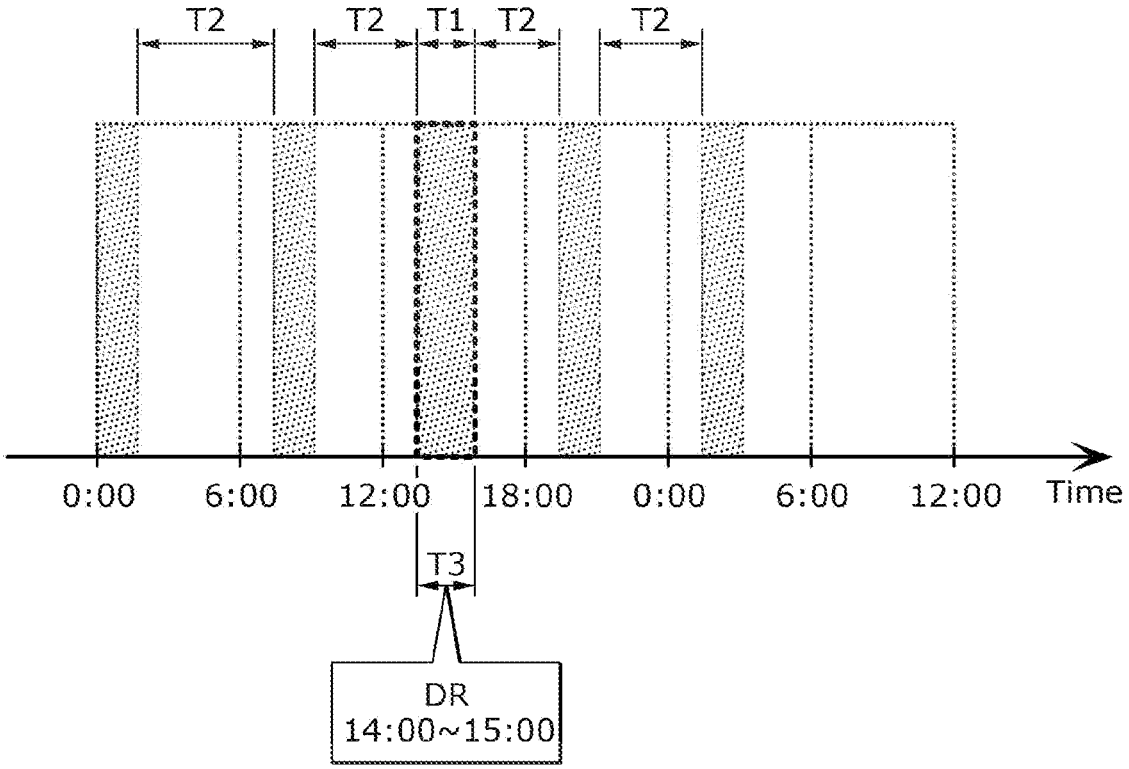
FIG. 3B is a time chart illustrating an example of a defrosting schedule for a power saving request.

Setting unit 12 sets a defrosting schedule including execution time period T1 and execution interval T2 of the defrosting control for refrigeration equipment 2, based on the schedule information obtained by obtainer 11 (see FIG. 3A and FIG. 3B). In the embodiment, when the schedule information obtained by obtainer 11 indicates that power saving is scheduled on the execution day for a power saving request, setting unit 12 sets a defrosting schedule for a power saving request. On the other hand, when the schedule information obtained by obtainer 11 indicates that power saving is not scheduled on the execution day for a power saving request, setting unit 12 sets a normal defrosting schedule that is predetermined.

In the embodiment, execution time period T1 of the defrosting control is one hour. Execution time period T1 of the defrosting control is not limited to one hour but may be more or less than one hour.

Furthermore, in the embodiment, execution interval T2 of the defrosting control is between four hours and six hours, inclusive. The lower-limit value of execution interval T2 of the defrosting control is set to a time period that makes it possible to maintain the quality of an item that is a target for cooling in refrigeration equipment 2. Furthermore, the upper-limit of execution interval T2 of the defrosting control is set to a time period that makes it possible to prevent the cooling performance of refrigeration equipment 2 from deteriorating due to frost formation. As long as the above-described conditions are satisfied, the lower-limit value and the upper-limit value of execution interval T2 of the defrosting control need not be four hours and six hours, respectively.

Setting examples of execution time period T1 and execution interval T2 of the defrosting control will be described below. It should be noted that setting unit 12 may set execution time period T1 and execution interval T2 of the defrosting control using a first setting example or a second setting example, which are to be described below, or using other method. Furthermore, execution time period T1 and execution interval T2 of the defrosting control may be default values.

In the first setting example, setting unit 12 sets at least one of execution time period T1 or execution interval T2 of the defrosting control, based on item information regarding an item that is a target for cooling in refrigeration equipment 2. For example, setting unit 12 stores, in storage 14, reference data in which item information is associated with execution time period T1 and/or execution interval T2 of the defrosting control. Then, when setting unit 12 obtains item information, setting unit 12 retrieves, from the reference data, execution time period T1 and/or execution interval T2 of the defrosting control corresponding to the item information obtained.

The item information may include the type and the number of items put in refrigeration equipment 2 (showcase 21), as an example. Furthermore, the item information may include, as an example, the inside temperature of refrigeration equipment 2 (showcase 21). When the item information is about the type and the number of items, the item information can be obtained by capturing an image of showcase 21 with an imaging device and then performing appropriate image processing on the captured image, for example. Furthermore, when the item information is about the inside temperature of showcase 21, the item information can be obtained by receiving a detection result from a temperature sensor provided in showcase 21, for example.

In the second setting example, setting unit 12 sets at least one of execution time period T1 or execution interval T2 of the defrosting control, based on environment information regarding the environment in which refrigeration equipment 2 is placed. For example, setting unit 12 stores, in storage 14, reference data in which environment information is associated with execution time period T1 and/or execution interval T2 of the defrosting control. Then, when setting unit 12 obtains environment information, setting unit 12 retrieves, from the reference data, execution time period T1 and/or execution interval T2 of the defrosting control corresponding to the environment information obtained.

The environment information may include, as an example, the humidity (relative humidity or absolute humidity) of a space in which refrigeration equipment 2 is placed, or the season. When the environment information is about the humidity, the environment information can be obtained by receiving a detection result from a humidity sensor provided in the space, for example. Furthermore, when the environment information is about the season, the environment information can be obtained by receiving time information including the current date from a time server or a timer included in controller 10, for example.

Hereinafter, the normal defrosting schedule and the defrosting schedule for a power saving request will be described with reference to FIG. 3A and FIG. 3B, respectively. FIG. 3A is a time chart illustrating an example of the normal defrosting schedule. FIG. 3B is a time chart illustrating an example of the defrosting schedule for a power saving request. In the examples illustrated in FIG. 3A and FIG. 3B, time periods hatched with dots represent time periods during each of which the defrosting control is executed. Furthermore, in the examples illustrated in FIG. 3A and FIG. 3B, the defrosting control is control to stop the operation of cooling device 3, which is to be described later.

As illustrated in FIG. 3A, in the normal defrosting schedule, the defrosting control starts at a predetermined time at which schedule information is obtained. Then, in the normal defrosting schedule, the defrosting control is executed at execution interval T2 after the defrosting control that has started at the predetermined time. Specifically, in the normal defrosting schedule illustrated in FIG. 3A, the defrosting control is executed from 0:00 to 1:00, from 6:00 to 7:00, from 12:00 to 13:00, and from 18:00 to 19:00, on the execution day.

On the other hand, as illustrated in FIG. 3B, in the defrosting schedule for a power saving request, the defrosting control is executed at a predetermined time at which schedule information is obtained. Then, in the defrosting schedule for a power saving request, the defrosting control is executed in power saving time period T3 scheduled for power saving request and also executed at execution interval T2 before and after power saving time period T3. Specifically, in the defrosting schedule for a power saving request illustrated in FIG. 3B, the defrosting control is executed from 0:00 to 1:00, from 8:00 to 9:00, from 14:00 to 15:00 that is a time period corresponding to power saving time period T3, and from 20:00 to 21:00, on the execution day.

Here, examples of creating the defrosting schedule for a power saving request will be described. It should be noted that setting unit 12 may create the defrosting schedule for a power saving request by using a first creation example or a second creation example, which are to be described below, or using other method.

Figures 4, 5:
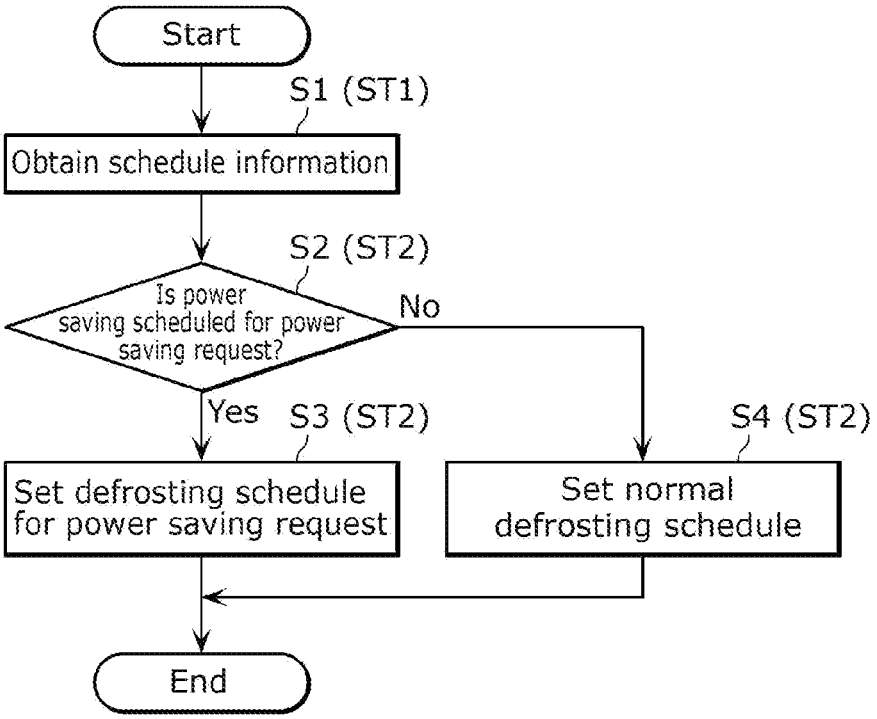
FIG. 4 illustrates an example of reference data used by the defrosting control system according to the embodiment in a first creation example.
FIG. 5 is a flowchart illustrating an operation example of the defrosting control system according to the embodiment when setting a defrosting schedule.

In the first creation example, setting unit 12 creates a defrosting schedule using reference data stored in advance in storage 14. An example of the reference data is illustrated in FIG. 4. FIG. 4 illustrates an example of the reference data used by defrosting control system 100 according to the embodiment in the first creation example. In FIG. 4, "DR time" represents the start time of power saving time period T3 scheduled for a DR (i.e., power saving request). Here, the power saving time period for a DR (power saving request) is one hour from the start time. Furthermore, in FIG. 4, "execution time" represents the start time of the defrosting control (i.e., start time of execution time period T1 of the defrosting control). Here, execution time period T1 of the defrosting control is one hour from the start time of the defrosting control. Furthermore, in the example illustrated in FIG. 4, execution interval T2 of the defrosting control is six hours. Furthermore, in the example illustrated in FIG. 4, the execution time period of the defrosting control (execution time period T1 of the defrosting control) is set assuming that the defrosting control is to stop the operation of cooling device 3, which is to be described later. Accordingly, when the defrosting control is control for heating by heater 4, which is to be described later, the execution time period of the defrosting control is set as a time period except for power saving time period T3 scheduled for power saving request, in the reference data.

As illustrated in FIG. 4, in the reference data, the start time of power saving time period T3 scheduled for a DR is associated with the start time of the defrosting control. For example, obtainer 11 is assumed to have obtained schedule information indicating that the start time of power saving time period T3 scheduled for power saving request is 13:00. In this case, setting unit 12 creates a defrosting schedule to cause the defrosting control to be executed from 1:00 to 2:00, from 7:00 to 8:00, from 13:00 to 14:00, and from 19:00 to 20:00, on the execution day, by referring to data of "13:00" of the "DR time" in the reference data.

In the second creation example, setting unit 12 creates a defrosting schedule based on power saving time period T3 scheduled for power saving request obtained by obtainer 11. Hereinafter, a specific example will be described with reference to FIG. 3B. In the example illustrated in FIG. 3B, execution time period T1 of the defrosting control is set assuming that the defrosting control is to stop the operation of cooling device 3, which is to be described later. Accordingly, when the defrosting control is control for heating by heater 4, which is to be described later, execution time period T1 of the defrosting control is set as a time period except for power saving time period T3 scheduled for power saving request.

In the example illustrated in FIG. 3B, obtainer 11 has obtained schedule information indicating that power saving time period T3 scheduled for power saving request is from 14:00 to 15:00 on the execution day. Accordingly, setting unit 12 creates a defrosting schedule to cause execution time period T1 of the defrosting control to be set to power saving time period T3 and also to be set to a time period from 8:00 to 9:00 and a time period from 20:00 to 21:00 that are time periods before and after execution interval T2 with reference to power saving time period T3.

As described above, in the embodiment, setting unit 12 sets a defrosting schedule according to a mode of the defrosting control. Specifically, when the defrosting control is to stop the operation of cooling device 3 that cools refrigeration equipment 2, setting unit 12 sets a defrosting schedule to cause the defrosting control to be executed in power saving time period T3. In such a case, since the operation of cooling device 3 is stopped during execution of the defrosting control, power consumption is reduced compared to when cooling device 3 is in operation. In other words, power saving control on refrigeration equipment 2 can be executed in power saving time period T3 (see FIG. 3B) by executing the defrosting control in power saving time period T3.

Figure 2:
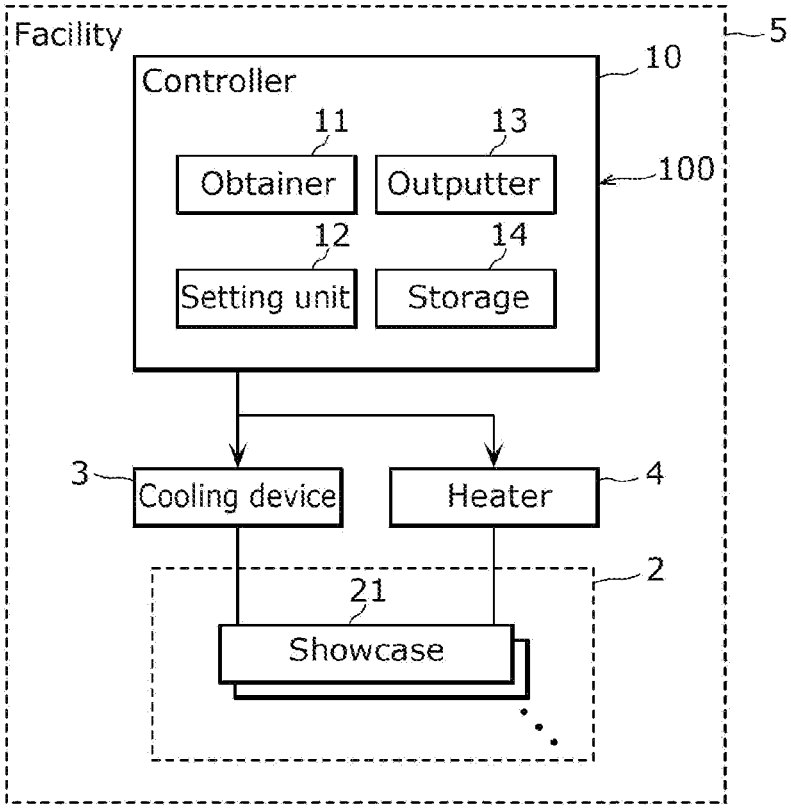
FIG. 2 is a block diagram illustrating another example of the overall configuration including the defrosting control system according to the embodiment.

On the other hand, when the defrosting control is control for heating by heater 4 as illustrated in FIG. 2 for example, setting unit 12 sets a defrosting schedule to cause the defrosting control to be executed in a time period except for power saving time period T3. FIG. 2 is a block diagram illustrating another example of the overall configuration including defrosting control system 100 according to the embodiment. In such a case, since the operation of cooling device 3 is stopped but heater 4 is in operation in execution of the defrosting control, the overall power consumption increases compared to when only cooling device 3 is in operation. In other words, power consumption of refrigeration equipment 2 can be reduced by executing the defrosting control in a time period except for power saving time period T3, compared to a case where the defrosting control is executed in power saving time period T3.

Outputter 13 outputs an instruction to execute the defrosting control for refrigeration equipment 2 according to the defrosting schedule set by setting unit 12. Specifically, outputter 13 transmits an instruction to execute the defrosting control to cooling device 3 when a timing at which the defrosting control should be executed has come, according to the defrosting schedule. It should be noted that, in a case where the defrosting control is control for heating by heater 4, outputter 13 transmits an instruction to execute the defrosting control to each of cooling device 3 and heater 4 when the above-described timing has come. Cooling device 3 and/or heater 4 that have received the instruction execute the defrosting control according to the instruction.

Storage 14 is a storage device in which necessary information (computer program and so on) for the processor of controller 10 to execute various controls is stored. For example, storage 14 is implemented by a semiconductor memory; however, storage 14 is not limited to this but may be implemented by other well-known electronic information storage means. In storage 14, the reference data used in the first setting example or the second setting example is stored, for example. Furthermore, in storage 14, the reference data used in the first creation example is stored, for example. Furthermore, in storage 14, the defrosting schedule set by setting unit 12 is stored.

2. Operation

Figure 6:
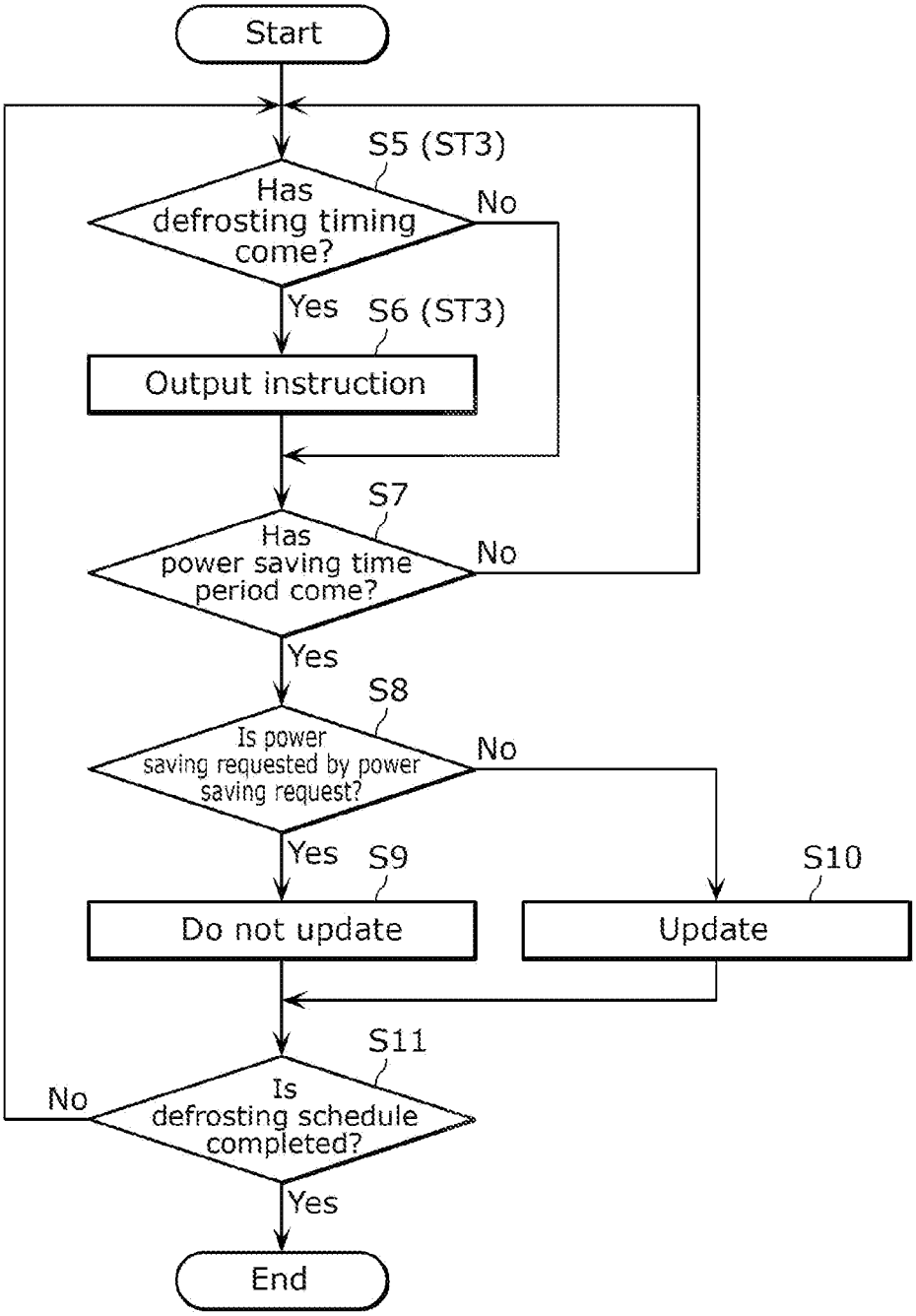
FIG. 6 is a flowchart illustrating an operation example of the defrosting control system according to the embodiment when the defrosting schedule for a power saving request has been set.
Figure 7:
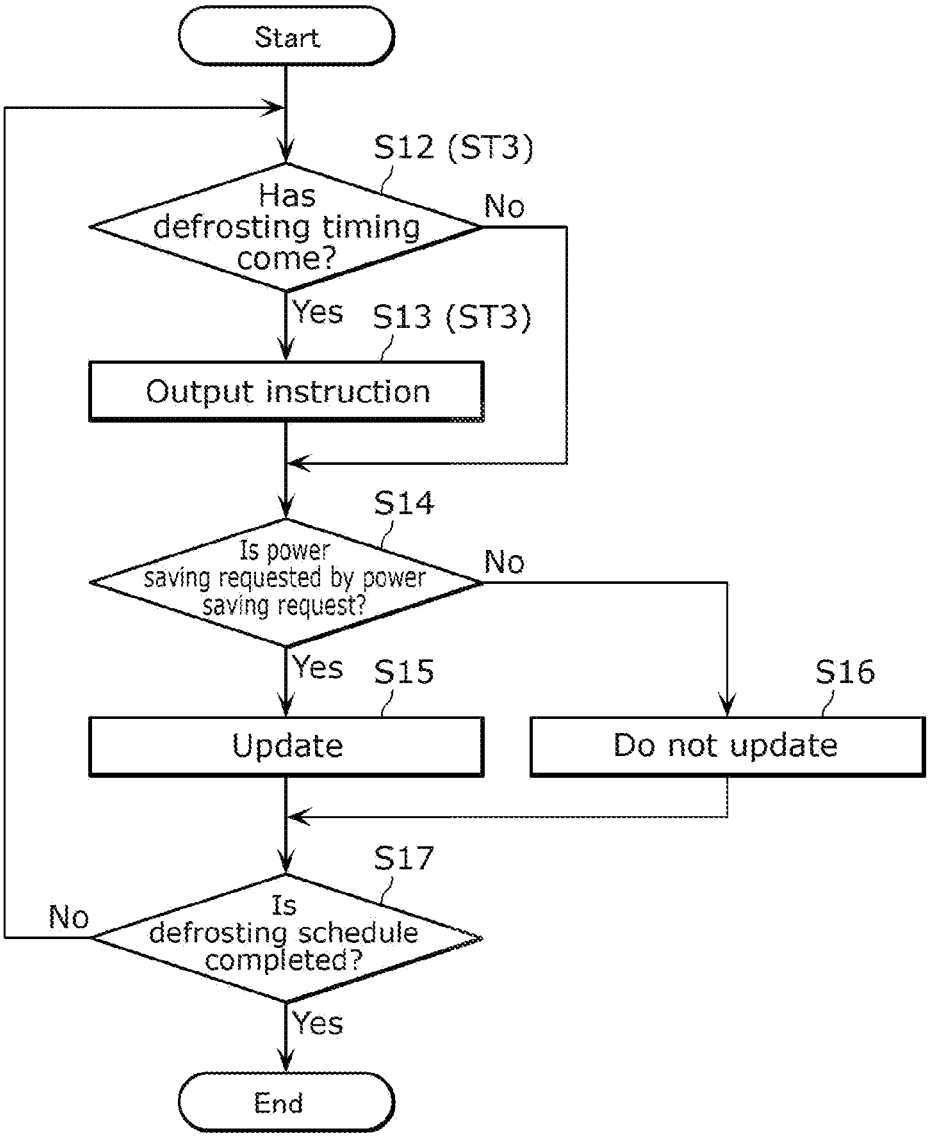
FIG. 7 is a flowchart illustrating an operation example of the defrosting control system according to the embodiment when the normal defrosting schedule has been set.

The operation of defrosting control system 100 configured as described above will be described below with reference to FIG. to FIG. 7. FIG. 5 is a flowchart illustrating an operation example of defrosting control system 100 according to the embodiment when setting a defrosting schedule. FIG. 6 is a flowchart illustrating an operation example of defrosting control system 100 according to the embodiment when a defrosting schedule for a power saving request has been set. FIG. 7 is a flowchart illustrating an operation example of defrosting control system 100 according to the embodiment when a normal defrosting schedule has been set. Hereinafter, description is carried out under the assumption that a defrosting control is to stop the operation of cooling device 3 that cools refrigeration equipment 2.

First, the operation of defrosting control system 100 according to the embodiment when setting a defrosting schedule will be described with reference to FIG. 5. Obtainer 11 obtains schedule information of the current day (execution day) at a predetermined time (at 0:00, for example) (S1). Process S1 corresponds to obtaining ST1 in a defrosting control method.

Setting unit 12 sets a defrosting schedule based on the schedule information obtained by obtainer 11. When the schedule information obtained by obtainer 11 indicates that power saving is scheduled on the execution day for a power saving request (S2: Yes), setting unit 12 sets a defrosting schedule for a power saving request (S3). On the other hand, when the schedule information obtained by obtainer 11 indicates that power saving is not scheduled on the execution day for a power saving request (S2: No), setting unit 12 sets a normal defrosting schedule that is predetermined (S4). Processes S2 to S4 correspond to setting ST2 in the defrosting control method.

Next, the operation of defrosting control system 100 according to the embodiment after setting a defrosting schedule will be described with reference to FIG. 6 and FIG. 7. Hereinafter, when setting unit 12 has set the defrosting schedule for a power saving request and when setting unit 12 has set the normal defrosting schedule will be described separately.

First, the operation of defrosting control system 100 when setting unit 12 has set the defrosting schedule for a power saving request will be described with reference to FIG. 6. According to the defrosting schedule set by setting unit 12, when a timing at which the defrosting control should be executed (defrosting timing) has come (S5: Yes), outputter 13 transmits an instruction to execute the defrosting control to cooling device 3 (S6). On the other hand, when the defrosting timing has not yet come (S5: No), outputter 13 does not execute anything. Processes S5 and S6 correspond to outputting ST3 in the defrosting control method.

Here, when power saving time period T3 scheduled for power saving request has started (S7: Yes), in a case where the power saving scheduled is actually requested by a power saving request (S8: Yes), setting unit 12 does not update the defrosting schedule but maintains the current defrosting schedule (S9). On the other hand, in a case where the power saving scheduled is not actually requested by a power saving request (S8: No), setting unit 12 updates the defrosting schedule (S10). Specifically, setting unit 12 updates the defrosting schedule so that the defrosting control will be executed at execution interval T2 after execution time period T1 of the defrosting control that is executed right before power saving time period T3. As described above, in a case where a defrosting schedule has been set based on the schedule information indicating that power saving is scheduled for a power saving request, setting unit 12 updates the defrosting schedule when the power saving scheduled is not actually requested by a power saving request.

The above-described series of processes S5 to S10 is repeated until the defrosting schedule is completed (S11: No). When the defrosting schedule is completed (S11: Yes), the operation of defrosting control system 100 ends.

Next, the operation of defrosting control system 100 when setting unit 12 has set the normal defrosting schedule will be described with reference to FIG. 7. According to the normal defrosting schedule, when the defrosting timing has come (S12: Yes), outputter 13 transmits an instruction to execute the defrosting control to cooling device 3 (S13). On the other hand, when the defrosting timing has not yet come (S12: No), outputter 13 does not execute anything. Processes S12 and S13 correspond to outputting ST3 in the defrosting control method.

Here, when unscheduled power saving is requested by a power saving request (S14: Yes), setting unit 12 updates the defrosting schedule (S15). Specifically, for example, in a case where the defrosting control is not executed and a certain period of time (e.g., four hours) has passed from the most recently executed defrosting control when unscheduled power saving is requested by a power saving request, setting unit 12 updates the defrosting schedule to cause the defrosting control to start at the time when the unscheduled power saving is requested. Furthermore, setting unit 12 updates the defrosting schedule so that the defrosting control will be executed at execution interval T2 after the defrosting control that has started at the time when the unscheduled power saving is requested. On the other hand, when power saving is not requested by a power saving request (S14: No), setting unit 12 does not update the defrosting schedule but maintains the current defrosting schedule (S16). As described above, in a case where a defrosting schedule has been set based on the schedule information indicating that power saving is not scheduled for a power saving request, setting unit 12 updates the defrosting schedule when unscheduled power saving is requested by a power saving request.

The above-described series of processes S12 to S16 is repeated until the defrosting schedule is completed (S17: No). When the defrosting schedule is completed (S17: Yes), the operation of defrosting control system 100 ends.

3. Advantageous Effects and so on

Hereinafter, the advantageous effects of defrosting control system 100 according to the embodiment will be described.

In defrosting control system 100 according to the embodiment, a defrosting schedule is set according to whether power saving is scheduled for a power saving request. Accordingly, in defrosting control system 100 according to the embodiment, when power saving is scheduled for a power saving request, a defrosting schedule taking the power saving scheduled into account can be set. Then, in defrosting control system 100 according to the embodiment, since defrosting control is executed for refrigeration equipment 2 according to the defrosting schedule for a power saving request, power consumption during a time period designated by a power saving request, for example, can be relatively reduced compared to power consumption during other time periods. In other words, defrosting control system 100 according to the embodiment has the advantage of easily meeting the need for reducing power consumption in response to a power saving request.

Furthermore, in defrosting control system 100 according to the embodiment, the defrosting control is executed for refrigeration equipment 2 in response to a power saving request while satisfying the number of executions and the execution time period of the defrosting control required for defrosting of refrigeration equipment 2. Accordingly, defrosting control system 100 according to the embodiment has the advantage of easily meeting the need for reducing power consumption in response to a power saving request while maintaining the quality of an item that is a target for cooling in refrigeration equipment 2 and preventing the cooling performance of refrigeration equipment 2 from deteriorating due to frost formation.

[Variations]

As described above, the embodiment is described as an exemplification of the technique disclosed in the present application. However, the techniques in the present disclosure are not limited to this embodiment and appropriate modifications, interchanges, additions, omissions, etc., to the embodiment are possible. Moreover, various elements described in the above embodiment may be combined to achieve a new embodiment.

Hereinafter, variations of the embodiment will be exemplified.

In the embodiment, when a defrosting schedule for a power saving request has been set and power saving is not actually requested by a power saving request, setting unit 12 updates the defrosting schedule; however, the present disclosure is not limited to this example. For example, when a defrosting schedule for a power saving request has been set and power saving in a time period that is different from a power saving time period predicted is requested by a power saving request, setting unit 12 may update the defrosting schedule.

In the embodiment, although a defrosting schedule is set to achieve both objectives of maintaining the quality of an item that is a target for cooling in refrigeration equipment 2 and preventing cooling performance from deteriorating due to frost formation, the present disclosure is not limited to this. For example, a defrosting schedule may be set to only maintain the quality of an item that is a target for cooling in refrigeration equipment 2. In such a case, the interval of the defrosting control may be set to four hours or longer in the defrosting schedule. Furthermore, for example, the defrosting schedule may be set to only prevent cooling performance from deteriorating due to frost formation. In such a case, the interval of the defrosting control may be set to six hours or shorter in the defrosting schedule.

In the embodiment, although outputter 13 outputs an instruction to execute the defrosting control to cooling device 3 when a timing at which the defrosting control should be executed has come according to the defrosting schedule set by setting unit 12, the present disclosure is not limited to this. For example, outputter 13 may output the defrosting schedule set by setting unit 12 to cooling device 3. In such a case, cooling device 3 executes the defrosting control according to the defrosting schedule received. Furthermore, in such a case, outputter 13 may output the defrosting schedule to cooling device 3 every time the defrosting schedule is updated.

Furthermore, for example, although defrosting control system 100 is implemented by a single device in the embodiment, it may be implemented by a plurality of devices. When defrosting control system 100 is implemented by a plurality of devices, the constituent elements of defrosting control system 100 may be arbitrarily assigned to any of the plurality of devices. For example, in the embodiment, a part of the constituent elements of defrosting control system 100 may be included in a server. In other words, the present disclosure may be implemented by cloud computing or edge computing.

Furthermore, for example, in the embodiment, part or all of the constituent elements of defrosting control system 100 of the present disclosure may be configured of dedicated hardware or may be implemented by executing a software program suitable for each of the constituent elements. Each of the constituent elements may be implemented by a program execution unit, such as a central processing unit (CPU) or a processor, retrieving and executing a software program stored in a recording medium such as a hard disk drive (HDD) or a semiconductor memory.

Furthermore, the constituent elements of defrosting control system 100 of the present disclosure may be configured of one or more electronic circuits. Each of the one or more electronic circuits may be a general circuit or a dedicated circuit.

The one or more electronic circuits may include a semiconductor device, an integrated circuit (IC), or a large scale integration (LSI), for example. The IC or the LSI may be integrated on a single chip or a combination of a plurality of chips. Here, the one or more electronic circuits are referred to as an IC or an LSI, but may also be referred to as a system LSI, a very large scale integration (VLSI), or an ultra large scale integration (ULSI), depending on the scale of integration. Furthermore, a field programmable gate array (FPGA) that is programmed after an LSI is manufactured can also be used for the same purpose.

Furthermore, general or specific aspects of the present disclosure may be realized as a system, a device, a method, an integrated circuit, or a computer program. Alternatively, general or specific aspects of the present disclosure may be realized as a non-transitory computer-readable recording medium, such as an optical disk, an HDD, or a semiconductor memory, in which the computer program is stored. For example, the present disclosure may be realized as a program for causing a computer to execute the defrosting control method according to the embodiment. Furthermore, the program may be stored in a non-transitory computer-readable recording medium such as a CD-ROM, or may be distributed via a communication path such as the Internet.

As described above, the embodiment is described as an exemplification of the technique disclosed in the present disclosure. To this extent, the accompanying drawings and detailed description are provided.

Accordingly, the constituent elements described in the accompanying drawings and the detailed description may include, not only constituent elements essential to solving the problem, but also constituent elements that are not essential to solving the problem in order to exemplify the aforementioned technique. Those unnecessary constituent elements should not be deemed essential due to the mere fact that they are described in the accompanying drawings and the detailed description.

Moreover, the above-described embodiment shows examples of techniques according to the present disclosure. Thus, various modifications, replacements, additions, omissions, or the like can be made within the scope of the claims or in a scope equivalent to the scope of the claims.

CONCLUSION

As described above, defrosting control system 100 according to the embodiment includes obtainer 11, setting unit 12, and outputter 13. Obtainer 11 obtains schedule information indicating whether power saving is scheduled for a temporary power saving request. Setting unit 12 sets a defrosting schedule including execution time period T1 and execution interval T2 of defrosting control for refrigeration equipment 2, based on the schedule information obtained by obtainer 11. Outputter 13 outputs an instruction to execute the defrosting control for refrigeration equipment 2 according to the defrosting schedule set by setting unit 12.

Accordingly, there is an advantage that power consumption during a time period designated by a power saving request can be relatively reduced compared to power consumption during other time periods, and therefore the need for reducing power consumption in response to a power saving request can be easily met.

Moreover, for example, setting unit 12 sets at least one of execution time period T1 or execution interval T2 of the defrosting control, based on item information regarding an item that is a target for cooling in refrigeration equipment 2.

Accordingly, there is an advantage that a defrosting schedule appropriate for an item that is a target for cooling in refrigeration equipment 2 can be easily set.

Furthermore, for example, setting unit 12 sets at least one of execution time period T1 or execution interval T2 of the defrosting control, based on environment information regarding the environment in which refrigeration equipment 2 is placed.

Accordingly, there is an advantage that a defrosting schedule appropriate for the environment in which refrigeration equipment 2 is placed can be easily set.

Furthermore, for example, obtainer 11 obtains the schedule information by prediction based on an execution history of one or more past power saving requests.

Accordingly, there is an advantage that a power saving schedule for a power saving request can be obtained without obtaining information from an external system.

Furthermore, for example, in a case where the defrosting schedule is set based on the schedule information indicating that power saving is scheduled for a power saving request, setting unit 12 updates the defrosting schedule when the power saving scheduled is not requested by a power saving request.

Accordingly, there is an advantage that it is possible to flexibly deal with a case where power saving is not actually requested by a power saving request, and thus a defrosting schedule can be easily optimized.

Furthermore, for example, in a case where the defrosting schedule is set based on the schedule information indicating that power saving is not scheduled for a power saving request, setting unit 12 updates the defrosting schedule when unscheduled power saving is requested by a power saving request.

Accordingly, there is an advantage that it is possible to flexibly deal with a case where unscheduled power saving is requested by a power saving request, and thus a defrosting schedule can be easily optimized.

Furthermore, for example, in a case where the defrosting control is control to stop the operation of cooling device 3 that cools refrigeration equipment 2, setting unit 12 sets the defrosting schedule to cause the defrosting control to be executed in power saving time period T3.

Accordingly, there is an advantage that power consumption during power saving time period T3 can be reduced compared to a case where the operation of cooling device 3 is stopped in a time period except for power saving time period T3, and therefore the need for reducing power consumption in response to a power saving request can be easily met.

Furthermore, for example, in a case where the defrosting control is control for heating by heater 4, setting unit 12 sets the defrosting schedule to cause the defrosting control to be executed in a time period except for power saving time period T3.

Accordingly, there is an advantage that power consumption during power saving time period T3 can be reduced compared to a case where control for heating by heater 4 is executed in power saving time period T3, and therefore the need for reducing power consumption in response to a power saving request can be easily met.

Furthermore, for example, a defrosting control method according to the embodiment includes obtaining ST1, setting ST2, and outputting ST3. In obtaining ST1, schedule information indicating whether power saving is scheduled for a temporary power saving request is obtained. In setting ST2, a defrosting schedule including execution time period T1 and execution interval T2 of defrosting control for refrigeration equipment 2 is set based on the schedule information obtained in obtaining ST1. In outputting ST3, an instruction to execute the defrosting control for refrigeration equipment 2 according to the defrosting schedule set in setting ST2 is outputted.

Accordingly, for example, there is an advantage that power consumption during a time period designated by a power saving request can be relatively reduced compared to power consumption during other time periods, and therefore the need for reducing power consumption in response to a power saving request can be easily met.

Furthermore, for example, a recording medium according to the embodiment is a non-transitory computer-readable recording medium that has recorded thereon a program for causing one or more processors to execute the defrosting control method.

Accordingly, for example, there is an advantage that power consumption during a time period designated by a power saving request can be relatively reduced compared to power consumption during other time periods, and therefore the need for reducing power consumption in response to a power saving request can be easily met.

INDUSTRIAL APPLICABILITY

The present disclosure is applicable to a defrosting control system and so on that execute a defrosting control in refrigeration equipment such as a showcase for refrigerating or freezing in a food store for example.

The invention claimed is:

1. A defrosting control system comprising:

one or more processors; and a non-transitory computer-readable recording medium storing a program for causing the one or more processors to perform:

obtaining schedule information indicating whether power saving is scheduled for a temporary power saving request;

setting a defrosting schedule including an execution time period of defrosting control for refrigeration equipment and an execution interval of the defrosting control, based on the schedule information; and outputting an instruction to execute the defrosting control for the refrigeration equipment according to the defrosting schedule, wherein the execution time period of the defrosting control and the execution interval of the defrosting control are set based on item information regarding an item that is a target for cooling in the refrigeration equipment and environment information regarding an environment in which the refrigeration equipment is placed, and the one or more processors perform updating the defrosting schedule, when the defrosting schedule has been set based on the schedule information indicating that power saving is scheduled for a temporary power saving request, but the power saving that has been scheduled is not in fact issued.

2. The defrosting control system according to claim 1, wherein the one or more processors perform obtaining the schedule information by prediction based on an execution history of one or more past temporary power saving requests.

3. The defrosting control system according to claim 1, wherein the one or more processors, based on a fact that the defrosting control is control to stop operation of a cooling device that cools the refrigeration equipment, perform setting the defrosting schedule to cause the defrosting control to be executed in a power saving time period scheduled for a temporary power saving request.

4. The defrosting control system according to claim 1, wherein the one or more processors, based on a fact that the defrosting control is control for heating by a heater, perform setting the defrosting schedule to cause the defrosting control to be executed in a time period except for a power saving time period scheduled by the temporary power saving request.

5. A defrosting control method comprising:

obtaining schedule information indicating whether power saving is scheduled for a temporary power saving request;

setting a defrosting schedule including an execution time period of defrosting control for refrigeration equipment and an execution interval of the defrosting control, based on the schedule information obtained in the obtaining; and outputting an instruction to execute the defrosting control for the refrigeration equipment according to the defrosting schedule set in the setting, wherein, in the setting, the execution time period of the defrosting control and the execution interval of the defrosting control is set based on item information regarding an item that is a target for cooling in the refrigeration equipment and environment information regarding an environment in which the refrigeration equipment is placed, and the method further comprises updating the defrosting schedule, when the defrosting schedule has been set based on the schedule information indicating that power saving is scheduled for a temporary power saving request, but the power saving that has been scheduled is not in fact issued.

6. A non-transitory computer-readable recording medium having recorded thereon a program for causing one or more processors to execute the defrosting control method according to claim 5.

* * * * *